US008037697B2

(12) United States Patent
LeClear et al.

(10) Patent No.: US 8,037,697 B2
(45) Date of Patent: Oct. 18, 2011

(54) REFRIGERATOR WITH AN AUTOMATIC COMPACT FLUID OPERATED ICEMAKER

(75) Inventors: Douglas David LeClear, Benton Harbor, MI (US); Andrew Michael Tenbarge, St. Joseph, MI (US); Guolian Wu, St. Joseph, MI (US); Jon Donald Tromblee, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 910 days.

(21) Appl. No.: 12/007,314

(22) Filed: Jan. 9, 2008

(65) Prior Publication Data

US 2009/0173089 A1 Jul. 9, 2009

(51) Int. Cl.

| | |
|---|---|
| ***F25C 5/06*** | (2006.01) |
| ***F25C 1/00*** | (2006.01) |
| ***A23G 9/00*** | (2006.01) |

(52) U.S. Cl. ..... 62/72; 62/66; 62/136; 62/353

(58) Field of Classification Search ..... 62/136, 62/151, 135, 344

See application file for complete search history.

(56) References Cited

U.S. PATENT DOCUMENTS

| | | | | |
|---|---|---|---|---|
| 2,770,102 | A | 11/1956 | Roedter | |
| 2,912,836 | A | 11/1959 | Harle | |
| 2,918,803 | A | 12/1959 | Bauerlein et al. | |
| 2,941,377 | A | 6/1960 | Nelson | |
| 2,941,378 | A | 6/1960 | Nelson | |
| 2,947,156 | A | 8/1960 | Roedter | |
| 2,999,367 | A | 9/1961 | Stanulis | |
| 3,290,892 | A | 12/1966 | Roedter | |
| 3,388,560 | A | 6/1968 | Moreland, II | |
| 3,390,543 | A | 7/1968 | Moreland, II et al. | |
| 3,739,595 | A | 6/1973 | Learn et al. | |
| 4,306,423 | A | 12/1981 | Webb et al. | |
| 4,628,699 | A | 12/1986 | Mawby et al. | |
| 4,635,444 | A | 1/1987 | Mawby et al. | |
| 4,680,943 | A | 7/1987 | Mawby et al. | |
| 4,990,169 | A * | 2/1991 | Broadbent | 62/75 |
| 5,329,780 | A * | 7/1994 | Broadbent | 62/72 |
| 7,194,868 | B2 * | 3/2007 | Yoshida et al. | 62/66 |
| 2004/0226311 | A1 * | 11/2004 | Ishitomi et al. | 62/348 |
| 2006/0086107 | A1 | 4/2006 | Voglewede et al. | |
| 2006/0086134 | A1 | 4/2006 | Voglewede et al. | |
| 2006/0086135 | A1 * | 4/2006 | Wu et al. | 62/351 |
| 2006/0207282 | A1 | 9/2006 | Visin et al. | |

* cited by examiner

*Primary Examiner* — Frantz Jules
*Assistant Examiner* — Timothy K Trieu
(74) *Attorney, Agent, or Firm* — John W. Morrison; Kirk W. Goodwin; Diederiks & Whitelaw, PLC

(57) ABSTRACT

An icemaker for a refrigerator having a cabinet with a refrigerated compartment and an unrefrigerated machine compartment includes a body portion formed with an inlet, an outlet and an opening. A flexible mold is positioned in the opening. A water supply is positioned to provide water to the flexible mold. A fluid supply circuit, including a pump mounted in the machine compartment, a first fluid conduit connected between the pump and the inlet, and a second fluid conduit connected to the outlet, provides warm fluid to the body portion. The icemaker forms ice during an ice production cycle and the fluid warmed in the machine compartment is used to partially melt and aid in releasing the ice which is then deposited in a ice storage bin during a harvest cycle.

16 Claims, 5 Drawing Sheets

REFRIGERATOR WITH AN AUTOMATIC COMPACT FLUID OPERATED ICEMAKER

BACKGROUND OF THE INVENTION

1. Field of the Invention

The present invention pertains to the art of refrigerators and, more particularly, to an automatic compact fluid operated icemaker arranged within a refrigerator.

2. Description of the Related Art

Household refrigerator/freezers are commonly sold with an icemaker, which is a great convenience to the consumer. Icemakers can be generally categorized into two classes based on the manner in which the ice is harvested from the ice cube tray. The most common method is for the ice to be formed in an ice cube tray incorporating multiple ejectors that forcibly eject the ice from ice cube recesses in the ice cube tray, typically defined by a metal mold. The other class of icemakers has ice cube trays that are inverted to expel the ice cubes from the ice cube recesses of the ice cube tray. These icemakers are usually made from a plastic material and are generally referred to as flextrays.

In the metal mold class of icemakers, it is common to use a resistance wire formed in the ice cube tray to heat the tray in order to melt the ice cubes at their interface with the tray, thereby enhancing the likelihood that the ice cubes can be successfully harvested from the tray. Unfortunately, this arrangement has many drawbacks. The heater that is used to heat the tray often is rated at 180 watts and thus contributes to energy use. Further, during each harvest cycle the freezer temperature is elevated. Along with the energy concerns, the resistance wire approaches are undesirable due to their cyclic temperature loading of the freezer compartment. The higher temperature swings of the freezer result in increased occurrences and severity of freezer burn, as well as an increase in sugar migration within products. The sugar migration specifically shows up in ice cream products.

In the flextray version icemaker, a rotational force is applied to an ice cube mold to impart a stress by flexing a plastic tray, with the flexing generating enough pressure on each ice cube to forcibly remove the cubes from the mold. In the flextray icemaker, the system repeatedly stresses the mold to a high level to guarantee ice cube release. This cyclic high stress has a degrading effect on the plastic and causes failure of cubes to release, or even worse a breakage of the mold. Without proper cube release, an over-fill event will occur. With a breakage of the mold, an even worse case of continuous water flow into the product can occur until it is sensed or the consumer intervenes.

Even with devices such as ejectors and heaters to aid in the harvesting of ice cubes, ice cubes can still become stuck in a tray. A stuck ice cube can result in an over-fill condition for the ice cube tray since the ice cube tray is typically filled with a predetermined charge of water based on the total volume of the ice cube recesses. In an over-fill condition, the excess water will spread across the multiple ice cube recesses and, upon freezing, form a layer of ice connecting the individual ice cubes, which further increases the likelihood that the ice cubes will not be harvested.

If the icemaker has a mechanism for detecting such an over-fill condition, the icemaker is shut down until the stuck ice is removed, resulting in a loss of ice production for the consumer. If the icemaker does not have an over-fill detection mechanism, the icemaker will continue to introduce water into the ice cube tray, which will eventually flow into the freezer to form a large block of ice, which is a great inconvenience to the consumer, especially if the ice forms on items contained within the freezer.

Based on the above, there still exists a need for an automatic icemaker system that will eject ice without using heat or flexing a mold that is subject to breaking. More specifically, there exists a need for an automatic compact fluid operated icemaker that produces ice without any of the drawbacks listed above.

SUMMARY OF THE INVENTION

The present invention is directed to an automatic compact icemaker preferably located in a refrigerated compartment of a refrigerator. The refrigerator preferably includes a cabinet with a fresh food compartment, a freezer compartment and an unrefrigerated machine compartment. Preferably, the icemaker is mounted in the freezer compartment but may also be placed in the fresh food compartment or in a refrigerator door, so long as there is sufficient cooling to form ice.

The icemaker includes a body portion formed with an inlet, an outlet and an opening. A flexible mold is positioned in the opening. An ice storage bin for receiving ice from the icemaker during a harvest cycle is located beneath the flexible mold. A water supply is positioned to provide water to the flexible mold. A fluid supply circuit including a pump is mounted in the machine compartment and provides warmed fluid. The machine compartment is not refrigerated and typically contains heat sources such as a compressor. The fluid supply circuit includes a first fluid conduit connected between the pump and the inlet and a second fluid conduit connected to the outlet. The fluid is preferably air, but could be other types of gasses or liquids. The fluid supply circuit preferably also includes a solenoid switch for closing the second conduit and controlling a pressure level of fluid in the body portion of the icemaker. Increased pressure in the body portion moves the flexible mold to release the ice. The solenoid switch is preferably located in the machine compartment, but may be located anywhere along the second conduit.

The icemaker forms ice during an ice production cycle and the fluid warmed in the machine compartment partially melts and aids in releasing the ice which is then deposited in the ice storage bin during a harvest cycle. With this arrangement, no additional heater is needed in the icemaker and several of the disadvantages of the prior art arrangements are overcome.

A control system is connected to the pump and the solenoid, while a sensor for detecting when water provided to the mold has become ice is connected to the control system. The control system will actuate the pump and solenoid when the water has become ice so as to eject the ice into the storage bin.

The icemaker also preferably includes a kickplate mounted on the body portion to guide the ice as the ice is deposited in the ice storage bin. The body portion of the icemaker is mounted on a support plate and the support plate, the kickplate and the body portion are all connected with fasteners.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF A PREFERRED EMBODIMENT

Figure 1:
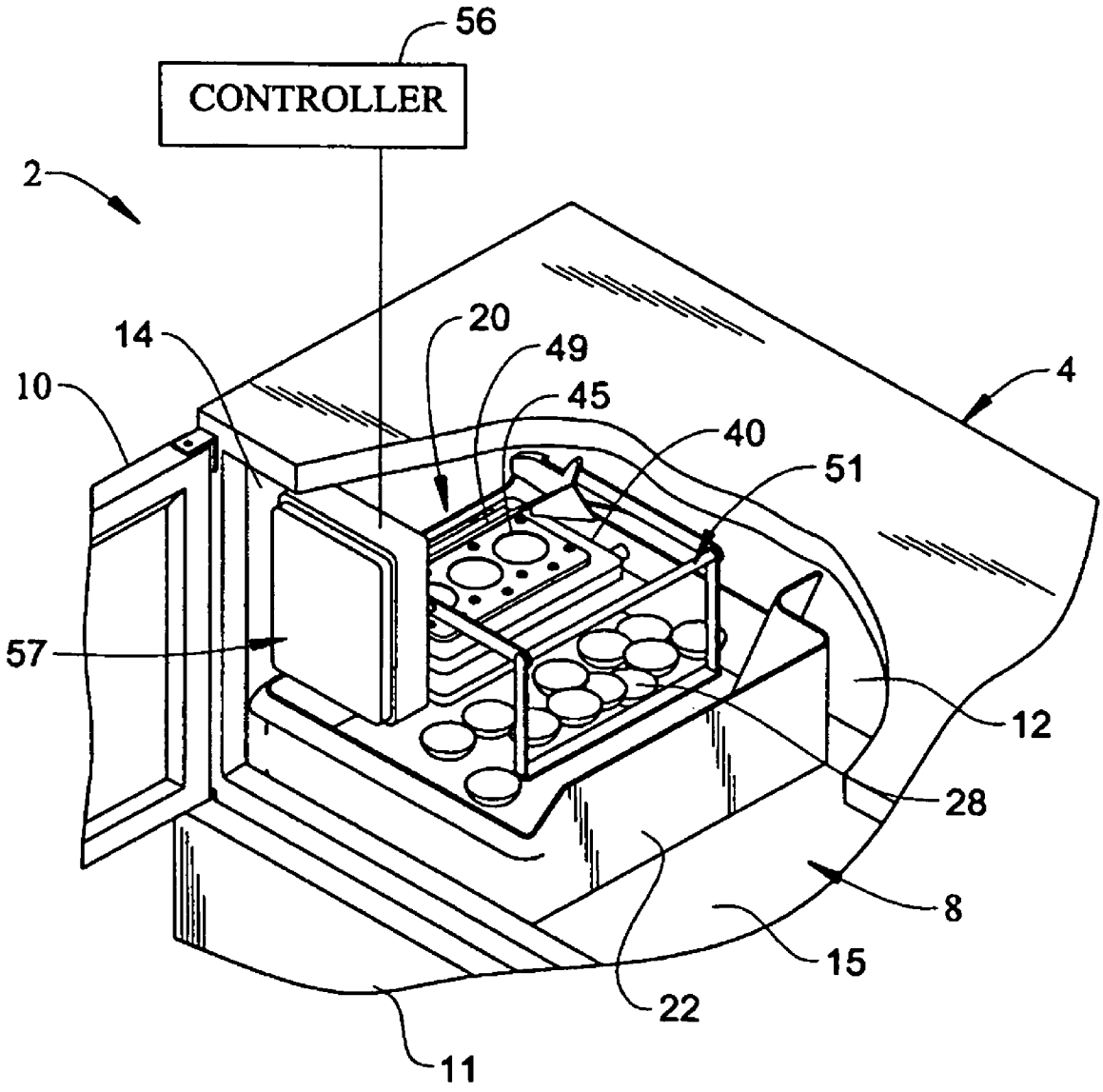
FIG. 1 is a partial, perspective view of a refrigerator depicting an automatic compact fluid operated icemaker constructed in accordance with the present invention arranged within an upper freezer compartment.

With initial reference to FIG. 1, a refrigerator, generally indicated at 2, includes a cabinet 4 having arranged therein a freezer compartment 8 which can be selectively accessed through the pivoting of a freezer door 10. Also provided is a fresh food door 11 which enables access to a fresh food compartment (not separately labeled). As shown, the refrigerator 2 constitutes a top mount style unit. However, as will become more fully evident below, the present invention is equally applicable to various other types of refrigerators, including side-by-side style units, bottom mount units and French door units.

The freezer compartment 8, as depicted in FIG. 1, shows a back wall 12, a side wall 14 and a bottom wall 15. An automatic compact icemaker 20 is located within the freezer compartment 8 and is preferably mounted to the side wall 14 of the freezer compartment 8. An ice cube bin 22 rests on the bottom wall 15 of the freezer compartment 8 and is located beneath the icemaker 20 to collect ice 28 harvested from the icemaker 20.

Figure 2:
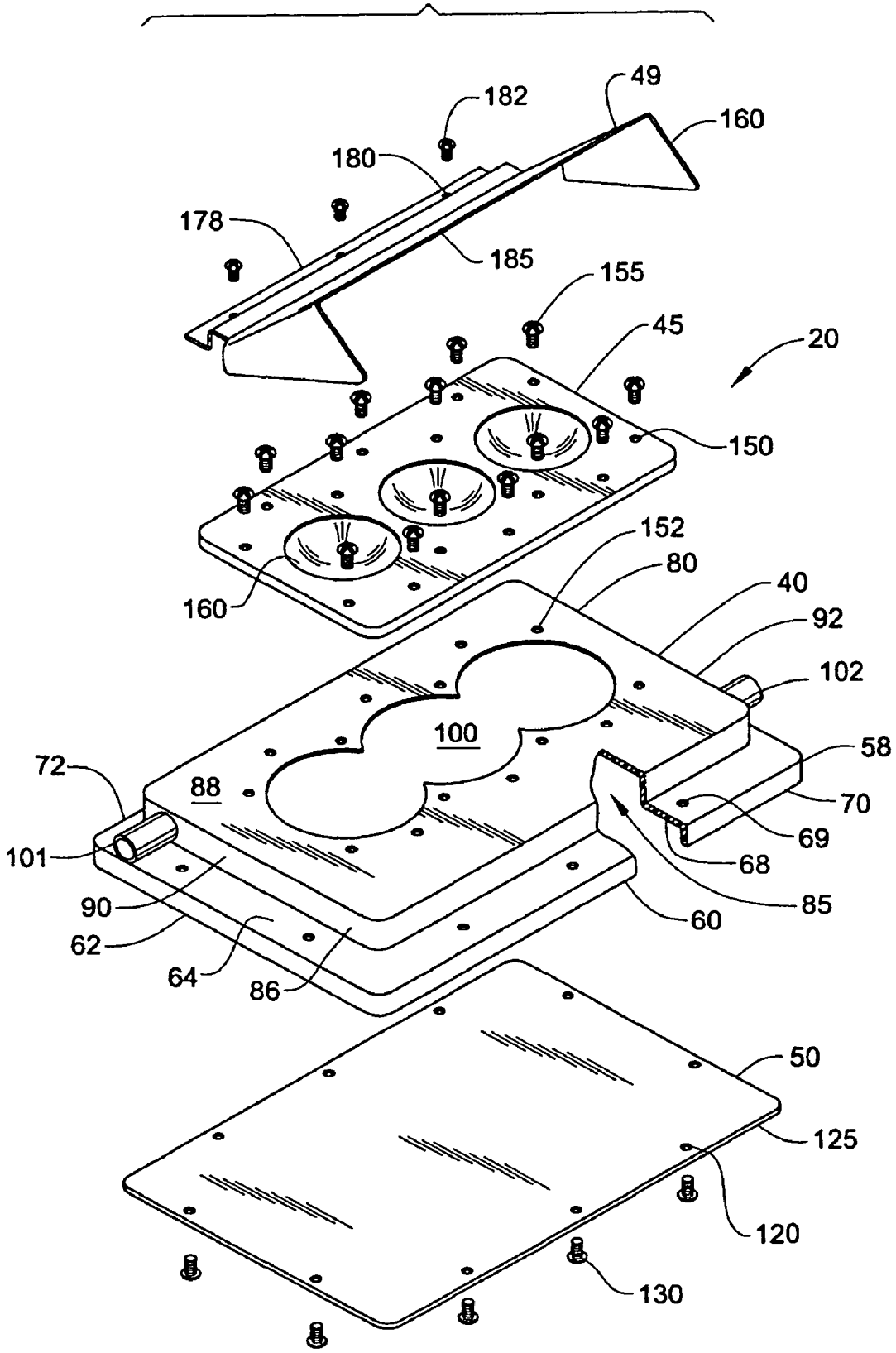
FIG. 2 is an exploded view of the automatic compact fluid operated icemaker of FIG. 1.

The icemaker 20 is generally formed of a body portion 40 having a flexible mold 45 attached thereto. A kickplate 49 is provided so that ice 28 formed by the assembly 20 is directed towards the ice bin 22. A support plate 50, as best seen in FIG. 2, is attached to the body portion 40. A bail arm 51 is provided to detect the level of the ice 28 formed in the ice bin 22. When the level of the ice 28 reaches a certain height, the bail arm 51 is moved, thus signaling a controller 56 to turn off the icemaker assembly 20. The controller 56 is preferably located behind a cover 57 as shown in FIG. 1. However, the controller 56 could be placed almost anywhere within the refrigerator 2 and is thus represented by a box. The details of the controller 56 are set forth below in the discussion regarding FIG. 4.

FIG. 2 illustrates the components of the icemaker 20 in an exploded view. The body portion 40 is generally a hollow construction, and preferably has a rectangular base 58 made of plastic. As can be seen in the cut-away portion of FIG. 2, the rectangular base 58 has a terminal edge 60 that extends around the periphery 62 of the base 58. Slightly inward of the periphery 62 is an elevated terrace 64. A bottom side of the terrace 64 forms a mating surface 68 for the support plate 50. The terrace 64 is also formed with holes 69 which are spaced around the rectangular base 58. As shown, there are three holes on each of the long sides 70, 72 of the rectangular base 58 and two holes on each of the short sides of the rectangular base 58. However, it should be noted that the particular number of holes is not important just so long as there are enough holes to provide a secure connection to the support plate 50 when the support plate 50 is connected to the rectangular base 58. A rectangular fluid container 80 is mounted to the base 58. Preferably, the fluid container 80 and base 58 form a hollow interior portion 85. The fluid container 80 has a wall 86 that extends upwardly from the terrace 60 along the entire periphery 62 of the terrace 64. The fluid container 80 also has a relatively planer top surface 88 that extends across the fluid container 80 from one side wall 90 to an other side wall 92. An opening 100 is provided in the top surface 88 and is generally in the shape of three overlapping circles. Of course, the shape of the opening 100 may be changed depending on what shape of ice is desired. One side wall 90 of the fluid container 80 is formed with an inlet 101 and the other side wall 92 is formed with an outlet 102. The body portion 40 is hollow, allowing fluid to pass from the inlet 101 through the hollow interior portion 85 to outlet 102.

The support plate 50 is generally shaped to fit against the mating surface 68 of the terrace 60 and within the outer periphery 62 of the base 58. As shown, the support plate 50 is rectangular and preferably made of metal. The support plate 50 has numerous holes 120 along its periphery 125 that are aligned with the holes 69 in the terrace 60 of the base 58. Fasteners 130 pass through holes 120 into holes 69 of main body portion 40, thus securing the two pieces together and closing off the bottom of the main body portion 40. The connection between the support plate 50 and the base 58 should be water tight to avoid any leakage during operation of the icemaker 20.

The flexible mold 45 is mounted on top of body portion 40. The flexible mold 45 closes off the opening 100 such that fluid entering the inlet 101 is retained within the icemaker 20. The flexible mold 45 has a series of holes 150 which align with the holes 152 in the body portion 40 so that a set of fasteners 155 may pass therebetween, thus fastening the flexible mold 45 to the body portion 40. The flexible mold 45 is preferably made of a soft deformable material such as silicone. As such, the flexible mold 45 will rest in the opening 100 of the fluid container 80 to form wells 160 designed to receive water. The kickplate 49, having side walls 162, is provided with a mounting tab 178. The mounting tab 178 has holes 180 which line up with holes (not shown) formed on the body portion 40 so that fasteners 182 may pass therethrough to mount the kickplate 49 to the body portion 40. The kickplate 49 also has a sloped deflector 185 located between the sidewalls 160 and shaped to guide ice 28 as it is ejected from the flexible mold 45.

Figure 3:
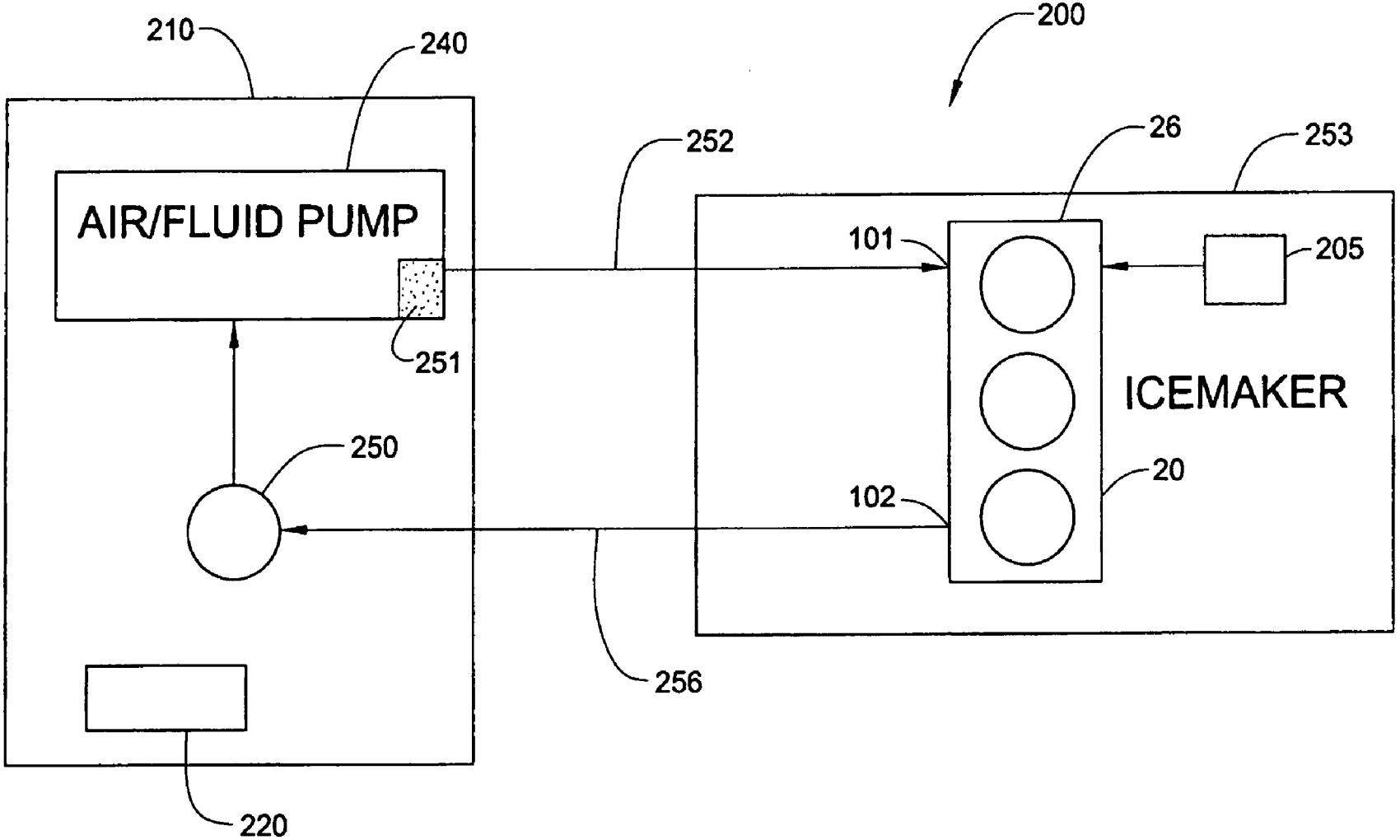
FIG. 3 is a schematic view of a piping circuit associated with the automatic compact fluid operated icemaker of FIG. 1.
Figure 5:
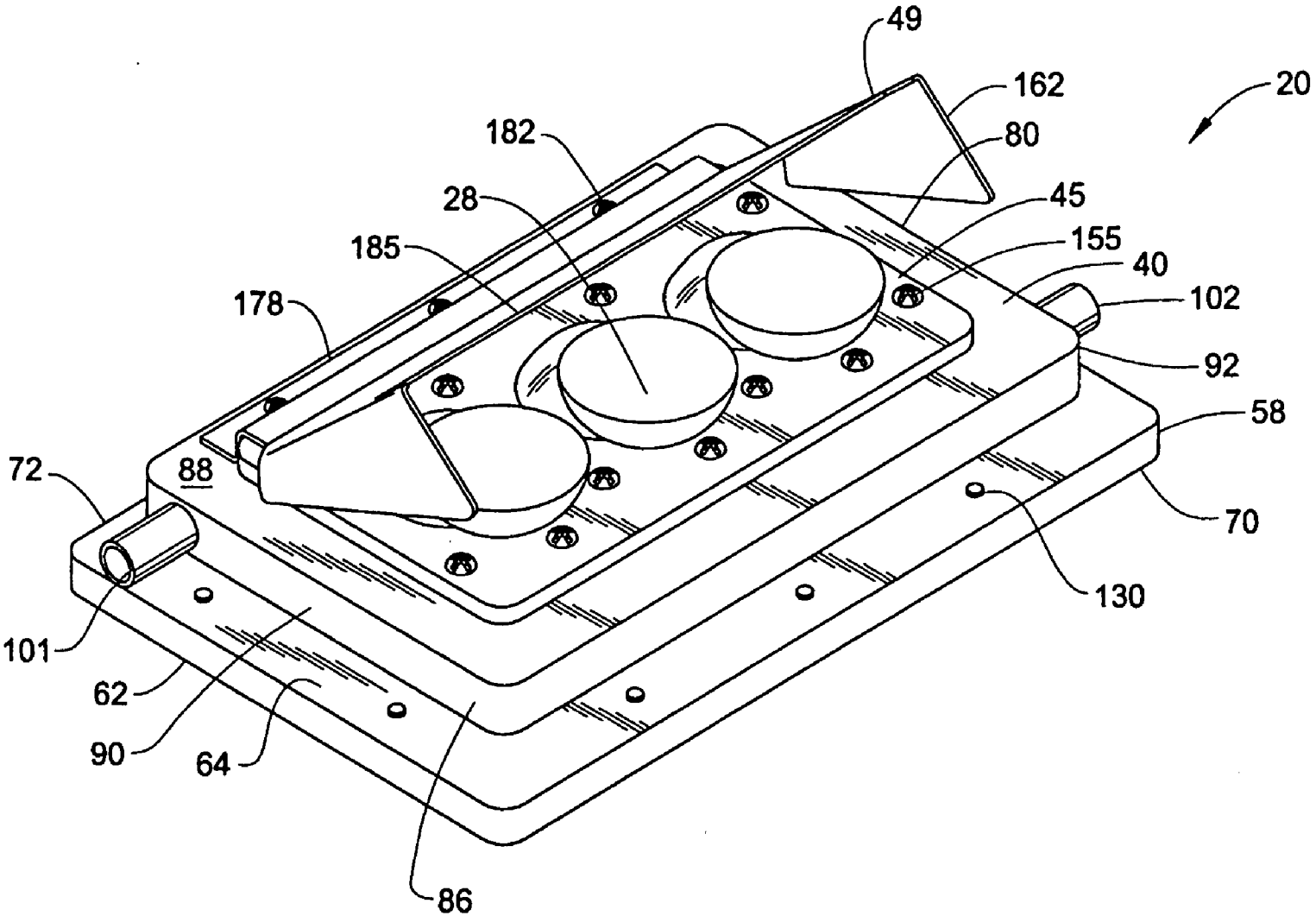
FIG. 5 is a perspective view of the automatic compact fluid operated icemaker of FIG. 1 in a harvest cycle.

Referring now to FIG. 3, there is shown an overall fluid supply circuit 200. A water supply 205 is arranged near the icemaker 26 for supplying water to the wells 160 of the flexible mold 45 identified in FIG. 2. An icemaker water supply is well known in the art and will not be discussed separately. As is conventional in a refrigerator, a machine compartment 210 has various machine components such as a compressor 220. The operation of the compressor 220 and all the other machine components of a refrigeration circuit are well known and will not be discussed here. Additionally, within the machine compartment 210 is an air/fluid pump 240 and a solenoid valve 250. The pump 240 provides fluid 251 through the circuit 200 from the machine compartment 210 through a first fluid conduit 252 to a refrigerator compartment 253 and into inlet 101 of the icemaker 20. Fluid 251 then travels, as mentioned above, through the main body portion 40 of the icemaker 20 to the outlet 102 and then back through a second fluid conduit 256 to a solenoid control valve 250. The solenoid control valve 250 is able to stop flow through the second fluid conduit 256. When the solenoid valve 250 or associated solenoid switch (not shown) is activated, pressure builds up within the second fluid conduit 256, thus increasing the pressure at opening 100 behind flexible mold 45. The increase in pressure in the hollow interior portion 85 between the opening 100 of main body portion 40 behind flexible mold 45 is pressurized and each well 160 formed by flexible mold 45 is gradually inverted and assumes an inflated position as indicated in FIG. 5. The inflated position occurs during the harvest cycle where ice 28 is ejected from the icemaker 20 and lands in ice bin 22.

Figure 4:
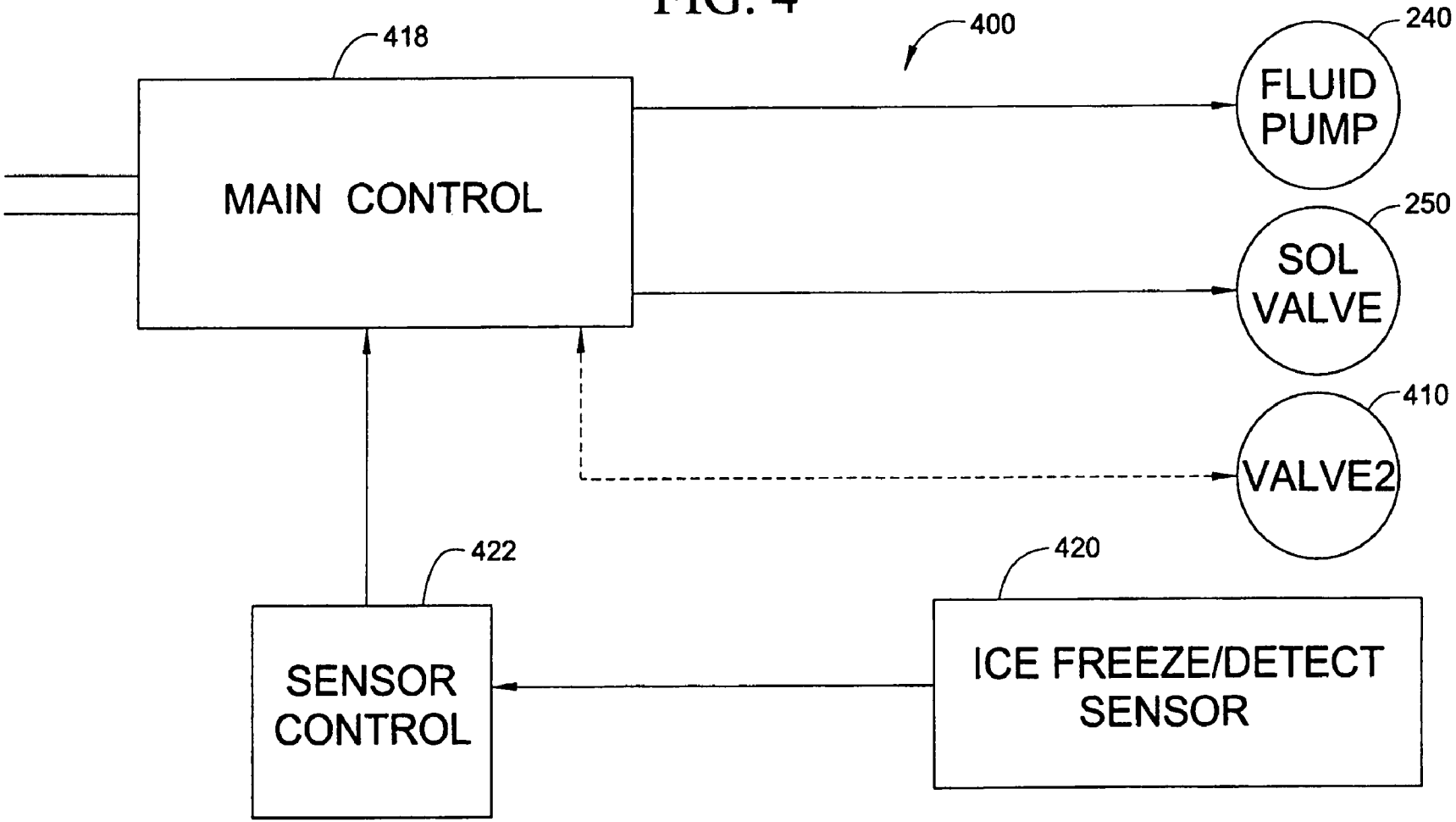
FIG. 4 is schematic view of an electrical control circuit for the automatic compact fluid operated icemaker of FIG. 1.

Turning now to FIG. 4, there is shown a control circuit 400 which is part of controller 56 for the icemaker 20. A main control unit 418 is shown with connections to the pump 240, the solenoid valve 250 and optionally a second valve 410. An ice freeze/detect sensor 420 is provided to determine whether or not water placed within the flexible mold 45 has turned to ice, thus sending a signal to a sensor control 422 which in turn sends a signal to the main control unit 418 and thus controls the pump 240 and the solenoid valve 250. Further details of a control circuit for an icemaker which can detect when water has turned to ice can be found in U.S. Patent Application Publication No. 2006/0086134 which is incorporated herein by reference.

In operation, water is initially supplied by water supply 205 to the icemaker 20 into wells 160 formed within flexible mold 45 over opening 100. As time passes, the water present within the wells 160 freezes. This freezing is detected by the ice freeze/detect sensor 420. A signal is then sent to the main control unit 418 to turn the pump 240 on. As can be seen from FIG. 3, the pump 240 is located within the machine compartment 210 which includes at least the compressor 220. The compressor 220 is naturally a heat source and thus heats the fluid within the pump 240 and circuit 200. When the pump 240 turns on, it provides air or other fluid to the inlet 101. The solenoid valve 250 is actuated by the main control unit 418 to prevent air from exiting the icemaker 20. The pressure behind the flexible mold 45 increases and the portion of the flexible mold 45 over the wells 160 inverts, thus pushing the ice 28 out of the icemaker 20 and into ice bin 22, as can best be seen in FIG. 5. The main control unit 418 then releases the solenoid switch and turns off the pump 240 so that more water can be placed in the icemaker 20. The main control unit 418 can also leave the solenoid valve 250 open and have the pump 240 on at the end of the freeze cycle just before the harvest cycle so as to slightly melt the ice within the mold 45. Then, the solenoid valve 250 may be closed to eject the ice 28.

Based on the above, it should be readily apparent that the icemaker arrangement of the present invention provides an efficient way of producing and ejecting ice. Although described with reference to a preferred embodiment of the present invention, it should be readily apparent to one of ordinary skill in the art that various changes and/or modifications can be made to the invention without departing from the spirit thereof. For instance, it should be realized that the particular shape of the ice made in accordance with the invention could be readily varied by simply providing a correspondingly configured mold. In fact, the mold could be easily changed by a consumer to provide various aesthetically varying sizes and shapes, such as star or character-shaped ice cubes. In general, the invention is only intended to be limited to the scope of the following claims.

What is claimed is:

1. A refrigerator comprising:

a cabinet with a refrigerated compartment and an unrefrigerated machine compartment comprising:

an icemaker assembly incorporating:

an icemaker mounted in the refrigerated compartment, said icemaker including a body portion formed with an inlet, an outlet and an opening, as well as a flexible mold positioned in said opening;

an ice storage bin for receiving ice from the icemaker during a harvest cycle;

a water supply positioned to provide water to the flexible mold;

an air supply circuit including a pump mounted in said machine compartment for providing a supply of warmed air, a first fluid conduit connected between the pump and the inlet and a second fluid conduit connected to the outlet, whereby said icemaker forms ice during an ice production cycle and the warmed air in the machine compartment partially melts and aids in releasing the ice which is then deposited in the ice storage bin during the harvest cycle.

2. The refrigerator according to claim 1, wherein the warmed air supply circuit further comprises a solenoid valve for closing the second conduit and controlling a pressure level of warmed air in the body portion, whereby the increased pressure in the body portion moves the flexible mold to release the ice.

3. The refrigerator according to claim 2, wherein the solenoid valve is in the machine compartment.

4. The refrigerator according to claim 3, further comprising a control system connected to the pump and the solenoid, and a sensor connected to the control system for detecting when water provided to the mold has become ice, whereby the control system will actuate the pump and solenoid valve when the water has become ice.

5. The refrigerator according to claim 1, wherein the icemaker includes a kickplate mounted on the body portion to guide the ice as the ice is deposited in the storage bin.

6. The refrigerator according to claim 5, wherein the icemaker further includes a support plate and the body portion is mounted on the support plate.

7. The refrigerator of claim 1, wherein the flexible mold is a soft deformable silicone material.

8. The refrigerator of claim 1, wherein the refrigerated compartment is a freezer compartment and the icemaker is located in the freezer compartment.

9. The refrigerator of claim 1, further comprising:

a compressor mounted in the machine compartment, said compressor being operated to cool the refrigerated compartment and generates heat as a natural heat source within the machine compartment, wherein the warmed air has been heated with the heat generated by the compressor.

10. An icemaker assembly for a refrigerator including a cabinet with a refrigerated compartment and a unrefrigerated machine compartment comprising:

an icemaker adapted to be mounted in the refrigerated compartment, said icemaker including a body portion formed with an inlet, an outlet and an opening, as well as a flexible mold positioned in said opening;

an ice storage bin for receiving ice from the icemaker during a harvest cycle;

a water supply positioned to provide water to the flexible mold; and an air supply circuit including a pump adapted to be mounted in said machine compartment for providing a supply of warmed air, a first fluid conduit connected between the pump and the inlet and a second fluid conduit connected to the outlet, whereby said icemaker forms ice during an ice production cycle and the warmed air partially melts and aids in releasing the ice which is then deposited in the ice storage bin during a harvest cycle.

11. The icemaker assembly according to claim 10, wherein the air supply circuit further comprises a solenoid valve for closing the second conduit and controlling a pressure level of the warmed air in the body portion, whereby the increased pressure in the body portion moves the flexible mold to release the ice.

12. The icemaker assembly according to claim 11, wherein the solenoid valve is in the machine compartment.

13. The icemaker assembly according to claim 12, further comprising a control system connected to the pump and the solenoid valve and a sensor connected to the control system for detecting when water provide to the mold has become ice, whereby the control system will actuate the pump and solenoid valve when the water has become ice.

14. The icemaker assembly according to claim 10, wherein the icemaker includes a kickplate mounted on the body portion to guide the ice as the ice is deposited in the storage bin.

15. The icemaker assembly according to claim 14, wherein the icemaker further includes a support plate and the body portion is mounted on the support plate.

16. The refrigerator of claim 10, wherein the flexible mold is a soft deformable silicone material.

* * * * *